United States Patent [19]

Tipper

[11] 4,291,561

[45] Sep. 29, 1981

[54] METHOD AND APPARATUS FOR FORMING CLIPS

[76] Inventor: Maynard J. G. Tipper, P.O. Box 23861, Oakland, Calif. 94623

[21] Appl. No.: 119,400

[22] Filed: Feb. 7, 1980

[51] Int. Cl.[3] ..... B21D 53/36

[52] U.S. Cl. ..... 72/187; 72/196; 140/82

[58] Field of Search ..... 140/82, 90, 91, 105; 72/185, 187, 196; 59/71, 77

[56] References Cited

U.S. PATENT DOCUMENTS

| | | | |
|---|---|---|---|
| 626,183 | 5/1899 | Martin | 72/196 |
| 873,200 | 12/1907 | Alley | 72/196 |
| 1,170,676 | 2/1916 | Safford | 140/82 |
| 2,975,817 | 3/1961 | Neff | 72/187 |

*Primary Examiner*—Lowell A. Larson

[57] ABSTRACT

Clips adapted to be subsequently employed in tying the necks of bags and the like are formed in a continuous ribbon of metallic material and adapted to be wound on a reel for subsequent use as ties. A continuous ribbon of flat material is bent alternately in opposite directions at spaced points along its length to form a continuous length of generally sinusoidal-shaped similar connected elements so that substantially all of the deformation of the material takes place when the approaching end of the ribbon is free and thus not subject to being stretched or compressed except so far as these deformations take place during the bending process. The continuous length of generally sinusoidal-shaped similar connected elements resulting from the bending step is passed between complementarily formed die elements similar to the teeth of a pair of mating gears so as to deform the crest of the sinusoidal elements to generally trapezoidal shaped elements which, when separated, serve as ties for surrounding the neck of a bag or the like.

8 Claims, 5 Drawing Figures

METHOD AND APPARATUS FOR FORMING CLIPS

This invention relates to a method and apparatus for forming flat clips somewhat similar to clips of the type shown in U.S. Pat. No. 3,022,571 dated Feb. 27, 1962.

Heretofore, in forming the clips of the subject type the method has been to subject a ribbon of flat metallic material to a series of complementarily formed dies which progressively deform the flat material to the generally trapezoidal shape shown in the reference patent. This procedure obviously results in a relatively large amount of stretching and other deformation of the material so as to alter the cross section of the latter and to reduce its resistance to stress. The main object of the present invention is to improve on the use of a series of progressive dies so as to minimize the deformation of the material employed to make the clips and to thus result in a superior product.

Another object of the invention is the provision of a relatively simple method of forming a length of serially connected clips in an extremely simple manner and which clips may subsequently be separated to form a plurality of clip elements adapted to be employed in a tying operation for the necks of bags and like articles.

Other objects and advantages of the invention will be apparent from the following specification and from the drawings.

Figure 1:
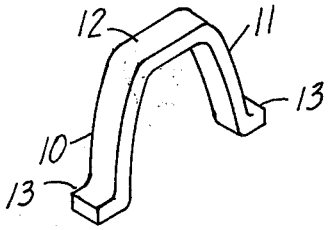
FIG. 1 is an enlarged isometric view of a clip of the type formed by the present invention.

The individual clip used in the subsequent tying operation is shown in FIG. 1 and comprises a generally trapezoidal shaped element having a pair of opposite sides 10, 11, a connecting top portion 12 and a pair of oppositely outwardly projecting short flanges 13. The opposite sides 10, 11 may be slightly curved as indicated in FIG. 1.

Figure 2:
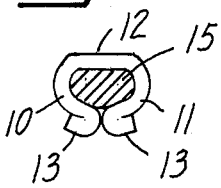
FIG. 2 is a side elevation of the clip after it has been deformed during the tying operation.

As disclosed in the above noted U.S. Pat. No. 3,022,571 the clip is subsequently employed in a typing machine to seal an article such as the neck 15 of a bag or the like as seen in FIG. 2.

Figure 3:
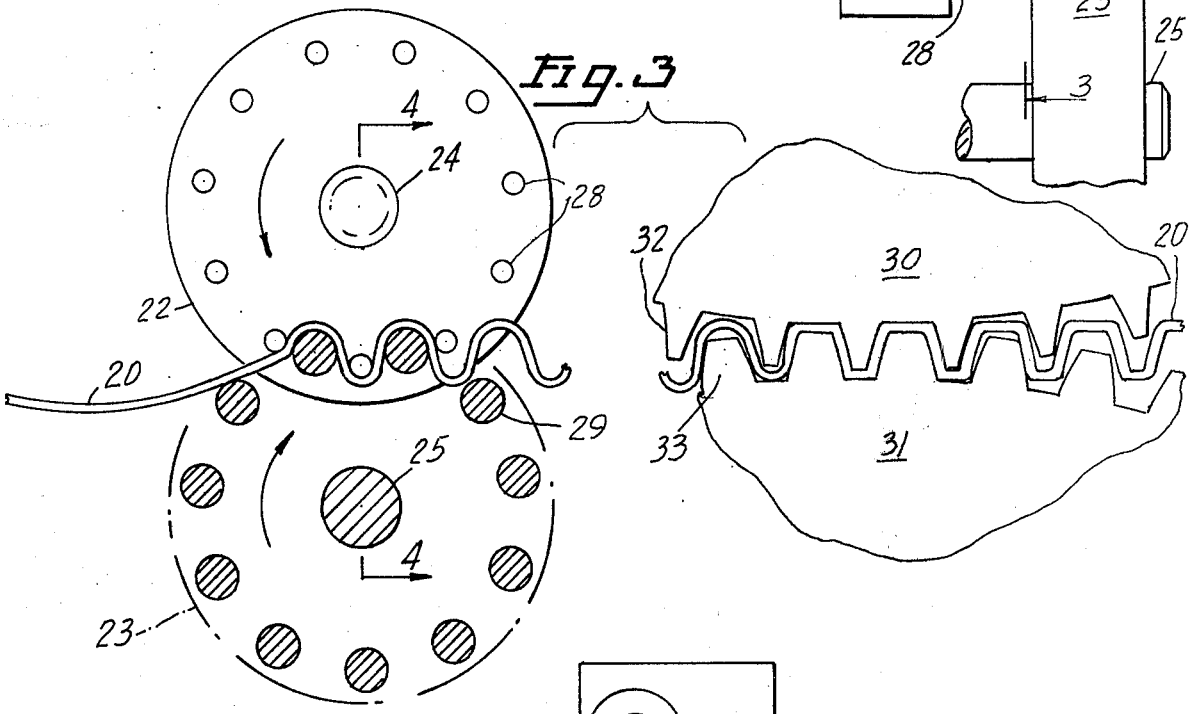
FIG. 3 is a seimschematic side elevation of the major steps carried out by the invention and showing an apparatus for performing the same.

By the present invention a ribbon of serially connected clips is formed from a relatively flat ribbon indicated at 20 in FIG. 3 and such ribbon may be provided from a reel (not shown) in a manner well known in the art.

The ribbon 20 is fed between a pair of upper and lower wheels 22, 23 which are carried by shafts 24, 25 respectively. In a manner that will be subsequently described the wheels 22, 23 are rotated in the direction indicated in FIG. 3. At spaced points around one face of wheel 22 are axially projecting pins 28 and at spaced points around the opposing face of wheel 23 are relatively larger diameter pins 29 which extend toward and in meshing relationship with respect to pins 28. The relative angular relationship of the wheels 22, 23 is such that, upon the rotation indicated, the ribbon 22 is bent at equally spaced points along its length in alternately opposite directions as best seen in FIG. 3 to provide a generally sinusoidally shaped ribbon with the crests on one side of the ribbon larger than the crests on the opposite side.

The above described method of bending the ribbon 20 has certain similarities to prior art methods for making corrugated wire and springs, such as disclosed in U.S. Pat. Nos. 2,643,688 and 2,582,576. However, by the present invention a very high degree of accuracy is obtained by arranging the pins 28, 29 so that after the initiation of the bending step a pair of coating pins 28, 29 are sufficiently close together so that there is very little clearance existing between the deformed ribbon and the pins on each side of it.

After the bending of the wire into a generally sinusoidal shaped continuous ribbon, the ribbon is then fed between a pair of gear-like dies 30, 31 as best seen in FIG. 3. The teeth 32, 33 of dies 30, 31 respectively are formed so that the ribbon is deformed to a generally trapezoidal shape as seen in FIGS. 1 and 3. It will be noted that the amount of deformation and therefore the amount of strain in the wire is very slight during this operation since the crests of the sinuosidal shaped wire are merely squared out to form the desired trapezoidal shape. In fact, the length of the wire resulting from the above described deforming steps remains the same as the straight length so that no stretching or thinning of the material results thereby insuring a uniform wire thickness and stronger clip. The finished wire may then be fed onto a reel (not shown) from which it may subsequently be removed by the user during a continuous typing operation which is well known in the art.

Figure 4:
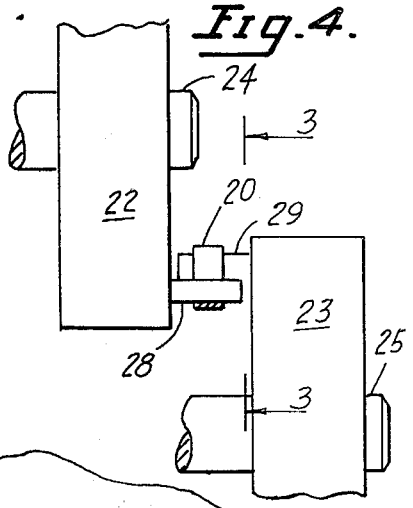
FIG. 4 is a fragmentary cross section as taken in a plane indicated by lines 4—4 of FIG. 3.
Figure 5:
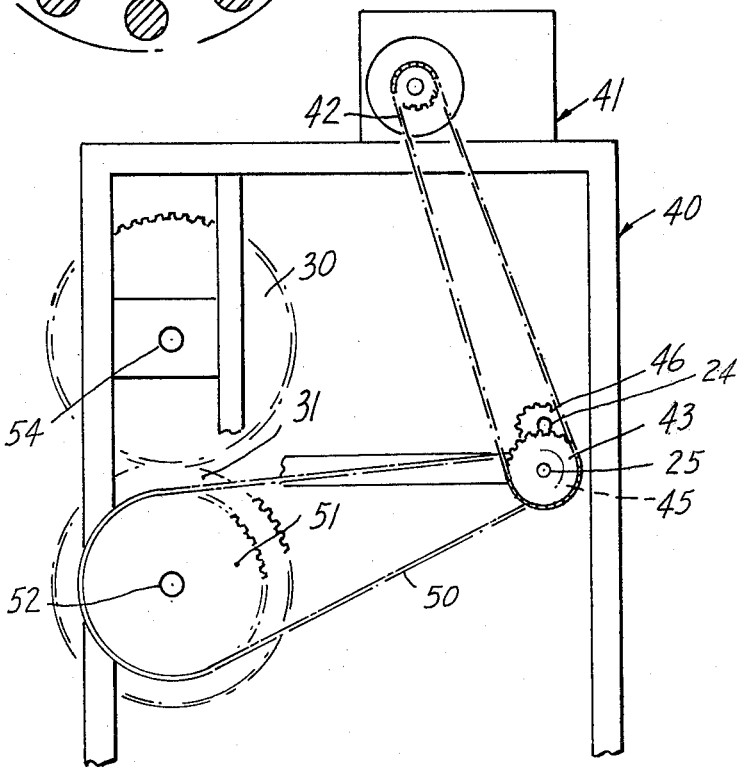
FIG. 5 is a small scale side elevation view of the apparatus of the present invention.

One type of drive which may be employed to operate the above described apparatus is shown in FIG. 5 wherein a frame generally designated 40 may be provided of angle iron or like material and which frame supports a motor reducer 41 the output shaft of which drives a chain 42 connected by sprocket 43 to the shaft 25 which carries the lower pinned wheel 23 (FIG. 4). Shaft 25 may be rotatably supported on suitable bearings (not shown) secured to frame 40. Shaft 25 also carries a gear 45 which meshes with a gear 46 carried by shaft 24 which in turn supports the upper pinned wheel 22.

By another drive chain 50 the shaft 25 drives a sprocket 51 supported on a shaft 52 which in turn drives the lower gear-like die 31 (FIG. 3). By this structure the upper gear-like die 30 may be an idler supported on shaft 54 which in turn is rotatably supported in frame 40.

It will be noted that the required very accurate relative spacing between pins 28, 29 may be achieved through the use of the coacting gears 43, 46 (FIG. 5) which, when properly fixed relative to their respective shafts provide the desired amount of separation between said pins 28, 289.

If desired, it is also possible to mount the shafts 52, 54 in adjustable bearings in a manner well known in the art so as to permit varying the distance between said shafts to allow variations in the final shape of the clips to be accomplished.

I claim:

1. The method of making connected flat clips for tying the necks of bags and the like comprising the steps of:

providing an elongated ribbon of generally flat metallic material, bending said ribbon at spaced points along its length alternately in opposite directions to form a continuous length of generally sinusidal shaped similar connected elements, and thereafter deforming the crests of the sinuoidal elements of said continuous length to generally trapezoidal shaped elements, whereby each of said trapezoidal elements may subsequently be separated from said length to provide a tie adapted to surround the neck of a bag or the like.

2. The method of claim 1 wherein the crests on one side of said sinusoidal ribbon are bent to a different radius of curvature than the crests on the opposite side of said ribbon.

3. The method of claim 1 wherein the length of said flat ribbon prior to the first bending step is unrestrained to minimize deformation of the same during said bending strip.

4. Apparatus for forming flat clips for use in tying the necks of bags and the like comprising:

a pair of rotatably supported members, said members each being provided with axially extending projections with the projections of one member extending toward the projections of the other member and in intermeshing relation and adapted to receive an elongated ribbon of metallic material therebetween, means for rotating one of said members for feeding said ribbon generally tangentially of said members and forming said ribbon to a connected series of similar sinuoidal shaped elements, a pair of rotatably supported intermeshing die members formed with teeth adapted to receive said sinusoidal shaped elements between the intermeshing teeth of said die members, the teeth of said die members being formed to deform the crests of said elements to form generally trapezoidal shaped elements.

5. Apparatus according to claim 4 wherein said axially extending projections are pins fixedly secured to said members.

6. Apparatus according to claim 5 wherein said pins are of different diameters.

7. Apparatus according to claim 4 wherein said flat ribbon is relatively unsupported prior to engagement with said projections to minimize deformation of the same while being bent.

8. Apparatus according to claim 5 wherein the spacing between a pair of coacting pins on said members is such that a minimal clearance exists beteen such pair and the ribbon therebetween.

* * * * *